United States Patent [19]

West et al.

[11] 4,081,352

[45] Mar. 28, 1978

[54] COMBINATION EXTRACTION-DEWAXING OF WAXY PETROLEUM OILS

[75] Inventors: Theodore H. West; John F. Eagen; David A. Gudelis, all of Sarnia, Canada

[73] Assignee: Exxon Research & Engineering Co., Linden, N.J.

[21] Appl. No.: 696,888

[22] Filed: Jun. 17, 1976

[51] Int. Cl.[2] ..... C10G 43/08

[52] U.S. Cl. ..... 208/36; 208/33

[58] Field of Search ..... 208/33, 36

[56] References Cited

U.S. PATENT DOCUMENTS 3,972,802 8/1976 Bushnell ..... 208/33

*Primary Examiner*—Herbert Levine

*Attorney, Agent, or Firm*—Edward M. Corcoran

[57] ABSTRACT

Waxy oils are solvent refined in a relatively low temperature, combination extraction-dewaxing process wherein the waxy oil is simultaneously extracted and at least partially dewaxed in a dilution chilling zone, sequentially followed by a second extraction and a second dewaxing to produce wax and useful lube oils, and wherein solvent does not have to be removed from the oil as it passes from step to step of the process. Further, if the second dewaxing is performed in a dilution chilling zone, then scraped-surface chillers are not required prior to filtering the wax from the oil.

13 Claims, 1 Drawing Figure

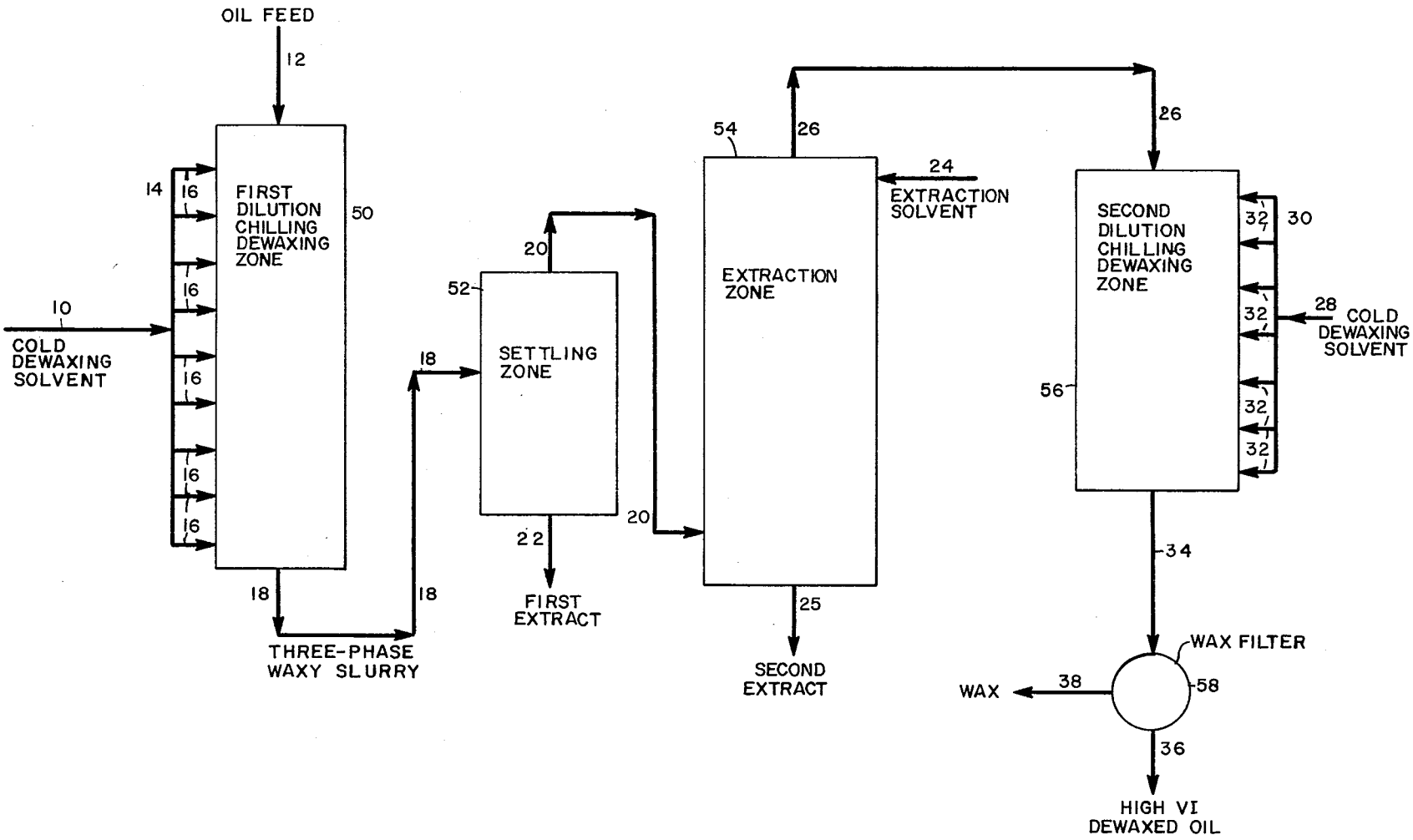
OIL FEED
12
FIRST DILUTION CHILLING DEWAXING ZONE
50
14
16
10
COLD DEWAXING SOLVENT
18
THREE-PHASE WAXY SLURRY
SETTLING ZONE
52
20
22
FIRST EXTRACT
EXTRACTION ZONE
54
24
EXTRACTION SOLVENT
25
SECOND EXTRACT
26
SECOND DILUTION CHILLING DEWAXING ZONE
56
30
32
28
COLD DEWAXING SOLVENT
34
WAX FILTER
58
36
HIGH VI DEWAXED OIL
38
WAX

COMBINATION EXTRACTION-DEWAXING OF WAXY PETROLEUM OILS

BACKGROUND OF THE INVENTION

1. Field of the Invention

This invention relates to a process for solvent extracting and dewaxing a waxy petroleum oil. More particularly, this invention relates to a relatively low temperature combination extraction-dewaxing process wherein a waxy lube oil stock is simultaneously extracted and at least partially dewaxed in a dilution chilling zone, sequentially followed by a second extraction and a second dewaxing operation to produce wax and useful lube oils of at least two different VI levels and wherein extraction and dewaxing solvent does not have to be removed from the oil as it passes from zone to zone of the process.

2. Description of the Prior Art

It is well known in the art that in order to manufacture lube oils from unrefined, paraffinic lube oil stocks, the undesirable aromatic and polar constituents must be removed from the oil in order to increase the VI and oxidation stability and further, the wax must also be removed in order to increase the fluidity and reduce the pour point. The desired pour point depends on the service conditions for which the final oil is intended. Most methods for producing lube oil stocks comprise (1) distilling a lube oil fraction from a crude oil in an atmospheric or vacuum pipestill, (2) solvent extracting the lube oil fraction in an extraction zone to produce a raffinate phase and an extract phase with most of the solvent and the undesirable aromatic and polar constituents present in the extract phase and the desired lube oil in the raffinate, (3) removing the extraction solvent from the extract and raffinate phases, (4) solvent dewaxing the solvent-free raffinate to precipitate the wax therefrom thereby producing a waxy slurry and (5) separating solid wax from the slurry to produce an oil/solvent mixture containing the desired lube oil.

In many instances it is desired to obtain more than one lube oil stock from a single fraction. This requires multiple extraction and dewaxing operations with the concomitant necessity of removing the extraction solvent from each extracted stream of oil before it is solvent dewaxed. The extraction solvent is invariably removed from the oil by thermal means such as flash evaporation, distillation and stripping. Therefore, each oil/solvent mixture resulting from an extraction operation must be heated up to remove the solvent from the oil and then cooled down prior to entering the cool dewaxing zone. Another disadvantage of conventional extraction-dewaxing processes is the necessity of including scraped-surface chillers in the dewaxing operation unless autorefrigerative dewaxing is used. These chillers are very expensive and many of them are required because they have low throughputs.

In one particular type of solvent dewaxing process, waxy oil and solvent at approximately the same temperature are mixed in such a manner so as to effect complete and thorough solution of the oil and the solvent before being cooled or chilled. This solution is then cooled at a uniform, slow rate in scraped-surface chillers under conditions which tend to minimize agitation of the solution as the wax precipitates out. There is a continual loss of heat exchange capacity in these chillers due to decreasing cooling and heat transfer rate resulting from the deposition of wax on the heat transfer surfaces of the exchangers thereby acting as heat insulation. Further, poor filtration rates result because the wax crystals are mashed and broken by the scrapers inside the chillers. In another method of solvent dewaxing, dewaxing solvent is added to the oil at several points along a chilling apparatus. However, the waxy oil is first chilled without solvent until some wax crystallization has occurred and the mixture has thickened considerably. A first increment of solvent is introduced at this point in order to maintain fluidity, cooling continues and more wax is precipitated. A second increment of solvent is added to maintain fluidity. This process is repeated in scrapedsurface chillers until the desired oil-wax filtration temperature is reached, at which point additional solvent is added in order to reduce the viscosity of the mixture to that desired for the filtration step. In this method the temperature of the incrementally added solvent should also be about the same as that of the wax/oil/solvent mixture. If the solvent is introduced at a lower temperature, shock chilling of the slurry occurs resulting in the formation of small and/or acicula shaped wax crystals with attendant poor filter rate. In both this method and in the one previously described, it is necessary to provide heat exchangers to warm up the dewaxing solvent to the temperature of the oil in order to avoid shock chilling.

It is now well known that the adverse shock chilling effect caused by the incremental addition of cold dewaxing solvent can be overcome by introducing the waxy oil into an elongated, staged cooling zone or tower at a temperature above its cloud point and incrementally introducing a cold dewaxing solvent into said zone, along a plurality of points or stages therein, while maintaining a high degree of agitation so as to effect substantially instantaneous mixing of the solvent and wax/oil mixture as they progress through said zone. The basic concept is shown in U.S. Pat. No. 3,773,650, the disclosures of which are incorporated herein by reference and shall hereinafter be referred to as dilution chilling. This avoids the necessity of having to heat the dewaxing solvent up to the temperature of the waxy oil entering the dewaxing or chilling zone, gives better wax crystals resulting in higher filtration rates and also avoids the need for employing scrapers in the chilling zone, because the wax does not tend to deposit on the surfaces therein since it is the incoming cold solvent that cools the waxy oil in said zone and not cold, heat exchange surfaces. However, even in this process the waxy slurry resulting from the chilling zone must subsequently be cooled down to the wax filtration temperature via the use of scraped-surface chillers.

Therefore, in an extraction-dewaxing process it would be a considerable improvement to the art if one could eliminate the need for (a) using scraped-surface chillers, (b) having to remove the extraction solvent from the extracted oil prior to dewaxing same and (c) having to heat up the dewaxing and extraction solvents prior to mixing them with the oil.

SUMMARY OF THE INVENTION

In accordance with the instant invention, a process has now been discovered for simultaneously extracting and dewaxing a waxy petroleum oil feed which comprises the sequential steps of:

(a) simultaneously introducing cold solvent and said feed into a dilution chilling zone to form a three-phase slurry comprising solid wax, a first raffinate and first extract, the first raffinate and first extract having a wax content lower than that of the feed;

(b) passing the slurry from the dilution chilling zone to a separation zone wherein the first extract is separated from the solid wax and first raffinate;

(c) passing the solid wax and first raffinate from said separation zone to an extraction zone wherein the first raffinate is contacted with an extraction solvent, in the presence of the solid wax, to form a second raffinate and a second extract;

(d) separating the second extract from the second raffinate and wax;

(e) passing the wax and second raffinate from the extraction zone to a dewaxing zone and simultaneously therewith introducing dewaxing solvent into the dewaxing zone to precipitate wax from the second raffinate, the dewaxing zone being maintained at a temperature lower than that of the dilution chilling zone;

(f) separating the wax from the second raffinate; and (g) recovering a lube oil stock from the dewaxed second raffinate and at least one extract.

One of the many advantages of this process resides in the fact that one can carry out the extraction below the cloud point of the waxy feed, which permits cooling the wax/oil-solvent slurry down to the wax filtration temperature by using cold solvent, if the dewaxing zone is a second dilution chilling zone, thereby eliminating the need for following the dewaxing operation with scraped-surface chillers in order to reach the wax filtration temperature, as has heretofore been required. Of course, this advantage is not achieved if the dewaxing zone is not a dilution chilling zone. Another advantage of this process resides in the fact that solvent does not have to be removed from the raffinate as it passes sequentially from step to step of the process.

Essential to the operation of the instant invention is the requirement that the dilution chilling zone in which the simultaneous dewaxing-extraction takes place, along with the method of operation and introducing solvent into same, must be similar to that disclosed in U.S. Pat. No. 3,773,650 described supra, under Description of the Prior Art.

The waxy feed is introduced into the dilution chilling zone at a temperature slightly above its cloud point. The "cloud point" of an oil is defined as that temperature at which a cloud or haze of wax crystals first appears in an oil that is cooled under certain conditions (ASTM D-2500-66). In the case of heavy materials such as resids and bright stocks, it may be necessary to predilute the oil with solvent prior to its introduction into said zone. As the oil passes through the zone, it is mixed with cold solvent, under conditions of high agitation, and is cooled down to a temperature sufficient to precipitate a portion of the wax from the oil. At the same time that wax is precipitated from the oil, most of the undesirable aromatic and polar constituents are removed therefrom in a first extract which also contains most of the solvent used for the combination extraction-dewaxing. Therefore, a three-phase slurry is formed in the dilution chilling zone which comprises solid wax particles, a first extract and a first raffinate. The first raffinate contains most of the desired lube oil and some solvent. The temperature reached by the slurry in the dilution chilling zone generally falls below about 130° F, preferably between the ranges of 130° to −20° F, and most preferably from about 100° to 0° F.

The extract is separated from the wax and raffinate by any suitable means, such as feeding the slurry directly from the dilution chilling zone to a settling zone or tank wherein the extract separates from the raffinate and wax and forms a lower layer which is continuously removed from the settling zone. The raffinate and wax form an upper layer in the settling zone and are passed directly therefrom to an extraction zone wherein the first raffinate is contacted with an extraction solvent in the presence of the wax, to form a second extract and a second raffinate. This extraction generally takes place at about the same temperature which was ultimately reached in the dilution chilling zone, but in some cases may be as much as 50° F higher or lower. That is, the extraction generally takes place at a temperature ranging from 100° to −20° F and more preferably from about 100° to 0° F. The second extract contains most of the solvent and an oil with a VI of at least about 20 and which does not require any further extraction in order to obtain a useful lube oil stock. This extract is removed from the extraction zone, as a separate stream, and is then sent to further processing in order to remove the solvent and obtain a useful lube oil stock. In general, about 20 to 50 LV% (liquid volume) of the oil in the first raffinate is removed therefrom as part of the second extract.

The solid wax particles and the second raffinate are passed from the extraction zone directly to a dewaxing zone wherein they are contacted with cold dewaxing solvent which serves to precipitate wax from the second raffinate and dilute it to reduce its viscosity for filtration. The temperature reached by the slurry in this cooling zone is lower than the temperature in the extraction zone (at least about 30° F lower). In general, the slurry in this cooling zone will reach a final temperature of from about 70° to −50° F, and preferably from 20° to −20° F. This cooling zone may either be a second dilution chilling zone as hereinbefore described, supra, or it may be a conventional incremental solvent dilution dewaxing zone wherein the cooling is achieved via cold heat exchange surfaces in scraped-surface chillers. In any event, the function of this cooling zone is to dilute and further cool the second raffinate so as to precipitate additional wax, dilute and bring its temperature down to the final filtration temperature which ranges from about 70° to −60° F and preferably from 20° to −40° F.

The cooled, diluted slurry is fed from the dewaxing cooling zone to means such as filtration or centrifugation for separating the wax from the slurry. Preferred means for separating the wax from the diluted oil is via rotary drum vacuum or pressure filtration. The diluted, second raffinate is removed from the wax filter as an oily filtrate which is then further processed in order to separate the oil from the solvent, yielding an oil having a relatively high VI ranging from about 70 to 120.

The solvent used in the dilution chilling zone for the combined extraction/dewaxing operation should be a binary mixture, one component of which is either N-methyl-2-pyrrolidone (NMP) or dimethylformamide (DMF) and the second component selected from the group consisting of methylene chloride (MC), Freon-11, ethylene dichloride (EDC), propane and propene. The solvent used in the extraction zone should also be a binary mixture selected from one of the same two groups, but need not have the same composition as the solvent used in the combination extraction/dewaxing zone. Table 1 lists a number of solvents that have been found to be useful in the process of this invention.

The dewaxing solvent may be composed of or contain the same individual components as the solvent used in the dilution chilling and/or extraction zones, or it may be any solvent useful for dewaxing waxy petroleum oils. Representative examples of the latter are (a) the aliphatic ketones having from 3 to 6 carbon atoms, such as acetone, methyl ethyl ketone (MEK) and methylisobutyl ketone (MIBK), and (b) low molecular weight autorefrigerant hydrocarbons, such as ethane, propane, butane and propylene, as well as mixtures of the foregoing and mixtures of the aforesaid ketones and/or hydrocarbons with aromatics such as benzene, xylene and toluene. In addition, halogenated, low molecular weight hydrocarbons such as $C_1$–$C_4$ chlorinated hydrocarbons (e.g., dichloromethane, methane, etc.) and mixtures thereof, may be used either alone or in admixture with any of the forementioned solvents.

Any waxy petroleum oil stock or distillate fraction thereof may be extracted and dewaxed employing the process of this invention. Illustrative, but nonlimiting examples of such stocks are (a) distillate fractions that have a boiling range within the broad range of about 500° to 1300° F, with preferred stocks including the lubricating oil and specialty oil fractions boiling with the range of between about 550° and 1200° F, (b) bright stocks and deasphalted resids having an initial boiling point above about 800° F and (c) broad cut feed stocks that are produced by topping or distilling the lightest material off the crude oil leaving a broad cut oil, the major portion of which boils above about 500° or 650° F. Additionally, any of these feeds may be hydrocracked prior to distilling, deasphalting or topping. These may come from any source such as the paraffinic crudes obtained from Aramco, Kuwait, the Panhandle, North Louisiana, etc., naphthenic crudes, such as Tia Juana, Coastal crudes, etc., as well as the relatively heavy feed stocks, such as bright stocks having a boiling range of 1050+° F and synthetic feed stocks derived from Athabasca Tar Sands, etc.

BRIEF DESCRIPTION OF THE DRAWING

The attached drawing is a flow diagram of a preferred embodiment of the process of the instant invention.

DETAILED DESCRIPTION

Referring to the drawing, a feed such as an unrefined vacuum tower distillate of a waxy paraffinic oil boiling in the range of from about 500° to 1300° F and at a temperature above its cloud point is fed into dilution chilling zone 50 via line 12 wherein it is contacted with cold solvent. The solvent is fed to zone 50 via line 10, manifold 14 and multiple injection points 16. The rate of solvent flow through each inlet or injection point is regulated so as to maintain a desired temperature gradient along the length of zone 50. Preferably, the rate of solvent addition is such that the chilling rate of the oil is below about 10° F per minute and most preferably between about 1° and 5° F per minute. In general, the amount of solvent added to the feed in zone 50 will be between about 75 and 300 LV% of the oil and will enter zone 50 at a temperature low enough to insure that the three-phase slurry produced in said zone ultimately reaches a temperature below about 130° F, preferably between 130° to −20° F, and most preferably from about 100° to 0° F. The temperature of the incoming solvent required to achieve this result is, of course, dependent on the amount of solvent used to treat the oil, heat of mixing, etc., and most generally will range from between about +70° to −50° F.

The distillate is cooled in zone 50 to a temperature substantially below the cloud point thereof, thereby precipitating out a portion of the wax and, at the same time creating bulk liquid-liquid immiscibility between a first raffinate or oil-rich phase and a first extract or solvent-rich phase, with the first extract containing most of the solvent and most of the undesirable aromatic and polar constituents of the oil. These undesirable aromatic and polar constituents of the oil generally range from between about 10 and 50 LV% of the incoming feed. This three-phase slurry passes from the dilution chilling zone to settling zone 52 via line 18 wherein the first extract separates from the first raffinate and the solid wax. The extract is removed from zone 52 via line 22 and from there is sent to means for removing the solvent from the oil to produce an oil having a VI of less than about 20 and with a wax content lower than that of the distillate feed entering zone 50.

The first raffinate and solid wax are removed from zone 52 via line 20 and are passed to extraction zone 54, wherein they are contacted with an extraction solvent containing the same individual solvent components as the solvent employed in the dilution chilling zone, to form a second three-phase slurry comprising solid wax particles, a second raffinate and a second extract. The extraction solvent enters zone 54 via line 24 and is generally at a temperature of from about 0° to 100° F, and more preferably from about 30° to 80° F. The extraction takes place at a temperature either slightly higher or lower than the temperature ultimately reached by the wax, first raffinate and first extract in dilution chilling zone 50. The extraction temperature in zone 54 ranges from about 100° to −20° F and most preferably from 30° to 80° F, depending upon the solvent/oil miscibility characteristics and the pour point desired for the oil that will be recovered as the second extract. In general, in extraction zone 54 the first raffinate is treated with solvent to a solvent/oil treat ratio (based on batch treats) ranging of from about 50 to 600 LV% based on the original feed entering the dilution chilling zone and, most preferably from 75 to 350 LV%, thereby forming a second three-phase slurry comprising a second extract and a second raffinate in the presence of the solid wax particles. The second extract contains most of the extraction solvent along with an oil having an intermediate VI ranging from about 20 to 70. This extract is removed from zone 54 via line 25 from where it is sent to means for separating the solvent from the oil.

The wax and solvent-containing second raffinate are removed from zone 54 via line 26 and passed to a second dilution chilling dewaxing zone 56 wherein they are contacted with a cold dewaxing solvent entering zone 56 via line 28, manifold 30 and multiple injection points 32. The cold dewaxing solvent precipitates additional wax from the second raffinate and dilutes it in order to reduce its viscosity prior to filtration, so that a reasonable filtration rate will be obtained. The temperature reached by the second raffinate and the wax in zone 56 is lower than the lowest temperature reached in either dilution chilling zone 50 or extraction zone 54. In general, for any particular feed or run, the lowest temperature reached in zone 56 will range from about 70° to −60° F and preferably from 20° to −40° F, and will be at least about 30° F lower than the temperature reached in extraction zone 54. The temperature of the cold dewaxing solvent entering zone 56 via line 28 will generally range from +70° to −50° F and more preferably from +20° to −20° F. The treat ratio of the dewaxing solvent to the second raffinate in zone 56 will range from 50 to 600 LV% and preferably from 100 to 400 LV% based on the incoming feed. The diluted slurry comprising solid wax and diluted, dewaxed oil from the second raffinate is fed to rotary filter 58 via line 34 wherein the oily liquid is separated and removed from the wax as a filtrate via line 36, with the wax being removed from the filter via line 38. The filtrate comprising solvent and dewaxed oil is then sent to suitable means for removing the solvent from the oil such as flash evaporation, rectification, gas stripping, etc., and a relatively high VI oil, is recovered therefrom which has a VI of at least about 80. Cooling zone 56 may be either a dilution chilling dewaxing zone as disclosed in U.S. Pat. No. 3,773,650 or it may be any conventional type of dewaxing zone, including incremental dilution scraped-surface chillers. However, in consideration of economics and convenience, it is preferable to employ the dilution chilling dewaxing outlined in U.S. Pat. No. 3,773,650.

PREFERRED EMBODIMENT

The invention will be more apparent from the working examples set forth below.

Example 1

Referring to the drawing, a waxy, paraffinic distillate at a temperature of 130° F having a viscosity of 600° SUS at 100° F, a boiling range of 800° to 1100° F, an API gravity of 23 and a refractive index of 1.4892, is passed into dilution chilling zone 50 via line 12 wherein it is contacted with a solvent composed of an 80/20 LV% mixture of NMP/MC. This solvent, at a temperature of −20° F, enters zone 50 via line 10, manifold 14 and multiple injection points 16 to give a treat rate or ratio of solvent to feed of 150 LV% (based on batch treats) to produce a three-phase slurry containing solid wax, a first raffinate and a first extract. The slurry exits zone 50 at a temperature of 70° F via line 18 and is passed to settling zone 52. In zone 52 the first extract separates from the wax and first raffinate and settles out as a lower layer. It is removed from zone 52 via line 22 from whence it is sent to means for separating the solvent from the oil. The first extract contains most of the undesirable aromatic and polar constituents of the oily feed entering the dilution chilling zone which, in this case, amounts to about 22% of the feed. The properties of the first extract are shown in Table 2. The solid wax and first raffinate are removed from settling zone 52 via line 20 and passed to extraction zone 54 wherein they are contacted with a 70/30 LV% NMP/MC solvent at a temperature of 70° F and at a treat rate of 300% (based on a batch treat), to form a second raffinate and a second extract in the presence of the solid wax. The second extract is removed from zone 54 via line 25 and is sent to solvent recovery to yield an oil with a VI of 20 amounting to 21 wt.% of the untreated distillate entering dilution chilling zone 50. The properties of the second extract oil are also listed in Table 2. The second raffinate, and the solid wax having a combined yield of 57 wt.% (based on the untreated distillate entering zone 50) are passed from extraction zone 54 via line 26 to zone 56, which is a second dilution chilling zone, wherein they are contacted with a dewaxing solvent in an amount of 300 LV% based on the oil content of the second raffinate. The dewaxing solvent is a 30/70 LV% mixture of NMP/MC at a temperature of −20° F and enters dewaxing zone 56 via line 28, manifold 30 and multiple injection points 32, wherein it dilutes the waxy raffinate and precipitates additional wax therefrom. The dewaxed, diluted second raffinate and the solid wax particles, at a temperature of 15° F are passed from zone 56 via line 34 to rotary drum vacuum filter 58. The solid wax is removed from the filter via line 38. The solvent containing raffinate is removed from the filter via line 36 and is sent to solvent recovery means yielding 45.6 wt.% (based on the untreated distillate) of an oil having a viscosity index of 89. Additional properties of the recovered oil are listed in Table 2.

EXAMPLE 2

This example is similar to Example 1, except that the first and second extracts are combined prior to being sent to solvent recovery. In this example, the same feed as that used in Example 1 enters dilution chilling zone 50 via line 12 wherein it is contacted with a solvent mixture comprising 50/50 LV% of NMP/MC at a treat rate of 135 LV% of the oily feed (based on batch treats). The temperature of the combination extraction-dewaxing solvent entering dilution chilling zone 50 via line 10, manifold 14 and multiple injection points 16 is −20° F. In zone 50 the three-phase slurry that is formed comprising solid wax, a first raffinate and a first extract is removed via line 18, at a temperature of about 32° F, and passed to settling zone 52 wherein the first extract separates out and is removed from the first raffinate and solid wax via line 22. The first raffinate and solid wax are passed via line 20 from settling zone 52 to extraction zone 54 wherein they are contacted with an extraction solvent at a temperature of 32° F comprising a 50/50 LV% mixture of NMP/EDC and a treat rate of 315 LV%, to form a second raffinate and a second extract in the presence of the solid wax particles. The second extract is removed from extraction zone 54 via line 25, is combined with the first extract from zone 52. The combined extracts are then sent to solvent recovery means and yield 48 wt.% of oil based on the untreated distillate entering zone 50. The properties of this oil are listed in Table 3. The second raffinate and wax are fed from zone 54 to a second dilution chilling zone 56 via line 26 wherein they are contacted with a cold (10° F) dewaxing solvent comprising a 50/50 LV% mixture of EDC/MC at a treat rate of 400 LV%, based on the second raffinate plus wax entering said zone, to precipitate additional wax from the second raffinate and also dilute same for filtration. The solid wax and diluted, dewaxed second raffinate are passed to filter 58 via line 34 wherein the wax is separated from the diluted oil, the wax being removed from the filter via line 38. The solvent-containing oil is removed as filtrate via line 36 and sent to solvent recovery means to yield 39 wt.% (based on the untreated distillate) of a dewaxed oil having a viscosity index of 88 and a pour point of 31° F as shown in Table 3.

EXAMPLE 3

The same feed as that used in Examples 1 and 2 was extracted with phenol at a treat level of 300 LV% at a temperature of about 160° F to produce an extract and raffinate, with the yield of the raffinate being 51.4 wt.% based on the feed. The phenol-containing raffinate was removed from the extraction zone and passed to a solvent recovery tower wherein the phenol was removed from the oil resulting in a hot, solvent-free raffinate. This hot (about 400° F) raffinate was then cooled down to a temperature of about 130° F and introduced into a dilution chilling dewaxing tower wherein it was contacted with a cold (−20° F) dewaxing solvent consisting of a 40/60 LV% mixture of MEK/MIBK. The waxy raffinate was dilution chilled down to about 40° F in the dilution chilling tower to produce a slurry of solid wax and diluted, dewaxed oil. This slurry was then fed to scraped-surface exchangers wherein it was further cooled down to a dewaxing temperature of 15° F and then sent to a rotary drum vacuum filter wherein the dewaxed, solvent-containing oil was separated from the wax. The solvent-containing oil was then sent to a solvent recovery tower to yield a dewaxed oil. The properties of the extract oil and dewaxed raffinate oil are shown in Table 4.

TABLE 1

TYPICAL EXTRACTION AND DEWAXING SOLVENT COMPOSITIONS[a,b]

| Combination Extraction-Dewaxing | Extraction | Dewaxing |
|---|---|---|
| 80/20 NMP/MC | 70/30 NMP/MC | 30/70 NMP/MC |
| 70/30 NMP/EDC | 60/40 NMP/EDC | 50/50 EDC/MC |
| 60/40 DMF/EDC | 50/50 DMF/EDC | 15/85 DMF/MC |
| 85/15 DMF/MC | 75/25 DMF/MC | 15/85 DMF/MC |

Notes:
[a]Solvent ratios are liquid volume.
[b]NMP - N-methyl-2-pyrrolidone
MC - methylene chloride
EDC - ethylene dichloride
DMF - dimethylformamide

TABLE 2

PROPERTIES OF RECOVERED OIL PER EXAMPLE 1

| | First Extract | Second Extract | Dewaxed Second Raffinate |
|---|---|---|---|
| Refractive Index at 75° C | 1.5590 | 1.5065 | 1.4680 |
| Viscosity, centistokes at 210° F | 6.1 | 21.5 | 13.3 |
| V.I. | <0 | 20 | 89 |
| Pour Point, ° F | 79 | 57 | 21 |
| A.P.I. Gravity | 8.3 | 18 | 26.7 |
| Yield based on untreated waxy distillate feed, wt.% | 22 | 21 | 45.6 |

TABLE 3

PROPERTIES OF RECOVERED OIL PER EXAMPLE 2

| | Combined Extract | Dewaxed Second Raffinate |
|---|---|---|
| Refractive Index at 75° C | 1.5243 | 1.4673 |
| Viscosity, centistokes at 210° F | 30 | 13.3 |
| V.I. | <20 | 88 |
| Pour Point, ° F | 30 | 31 |
| Yield based on untreated waxy distillate feed, wt.% | 48 | 39 |

TABLE 4

PROPERTIES OF OIL RECOVERED FROM CONVENTIONAL EXTRACTION AND DEWAXING PER EXAMPLE 3

| | Extract | Dewaxed Raffinate |
|---|---|---|
| Refractive Index at 75° C | 1.5210 | 1.4674 |
| Viscosity, centistokes at 210° F | 31 | 13.0 |
| V.I. | <20 | 88 |
| Pour Point, ° F | 99 | 18 |
| A.P.I. Gravity | 16 | 28 |
| Yield on untreated waxy distillate feed, wt.% | 48.6 | 41 |

What is claimed is:

1. A process for simultaneously extracting and dewaxing a waxy oil which comprises the sequential steps of:

(a) simultaneously introducing a cold, binary solvent and said oil into a dilution chilling zone to form a three-phase slurry comprising solid wax, a first raffinate and a first extract, the first raffinate and first extract having a wax content lower than that of the feed;

(b) passing the slurry from the dilution chilling zone to a separation zone wherein the first extract is separated from the solid wax and first raffinate;

(c) passing the solid wax and first raffinate from said separation zone to an extraction zone wherein the first raffinate is contacted with an extraction solvent, in the presence of the solid wax, to form a second raffinate and a second extract, the second extract having a wax content lower than that of the feed;

(d) separating the second extract from the second raffinate and wax;

(e) passing the wax and second raffinate from the extraction zone to a dewaxing zone and simultaneously therewith introducing dewaxing solvent into the dewaxing zone to precipitate wax from the second raffinate, the dewaxing zone being maintained at a temperature lower than that of the dilution chilling zone;

(f) separating the wax from the second raffinate; and (g) recovering a lube oil stock from the dewaxed second raffinate.

2. The process of claim 1 wherein one component of said binary solvent is either NMP or DMF and the second component of which is selected from the group consisting of MC, Freon-11, EDC, propane and propene.

3. The process of claim 2 wherein the solvent in the extraction zone is a binary mixture, one component of which is either NMP or DMF and the second component of which is selected from the group consisting of MC, Freon-11, EDC, propane and propene.

4. The process of claim 3 wherein the temperature in the dilution chilling, extraction and dewaxing zones ranges from 130° to −20° F, 100° to −20° F and 70° to −60° F, respectively.

5. The process of claim 4 wherein the waxy oil is introduced into the dilution chilling zone at a temperature above its cloud point.

6. The process of claim 5 wherein the temperature in the dewaxing zone is lower than the temperature in the dilution chilling or extraction zones.

7. The process of claim 6 wherein the dewaxing zone is a dilution chilling zone.

8. The process of claim 6 wherein the dewaxed second raffinate yields an oil having a VI of at least 70.

9. A process for simultaneously extracting and dewaxing a waxy lube oil feed which comprises the sequential steps of:

(a) simultaneously introducing said feed at a temperature slightly above its cloud point and a cold, binary solvent into a first dilution chilling zone to form a three-phase slurry comprising solid wax, a first raffinate and a first extract, the first raffinate and first extract having a wax content lower than that of the feed and said slurry reaching a temperature below 130° F in said zone;

(b) passing the slurry from the first dilution chilling zone to a separation zone wherein the first extract is separated from the solid wax and first raffinate;

(c) passing the solid wax and first raffinate from the separation zone to an extraction zone wherein the first raffinate is contacted with an extraction solvent, in the presence of the wax to form a second raffinate and a second extract;

(d) separating the second extract from the second raffinate and wax;

(e) passing the wax and second raffinate from the extraction zone to a second dilution chilling zone and simultaneously therewith introducing cold dewaxing solvent into said zone to precipitate wax from the second raffinate, the second dilution chilling zone being maintained at a temperature lower than that of the first dilution chilling zone;

(f) separating the wax from the second raffinate; and (g) recovering a useful lube oil stock from the dewaxed second raffinate and at least one of the said extracts.

10. The process of claim 9 wherein the solvent in both the first dilution chilling zone and in the extraction zone are binary mixtures, one component of which is either NMP or DMF and the second component of which is selected from the group consisting of MC, Freon-11, EDC, propane and propene.

11. The process of claim 10 wherein the temperature in the second dilution chilling zone is at least about 30° F lower than the temperature in the extraction zone.

12. The process of claim 11 wherein the temperature in the first dilution chilling zone, extraction zone and second dilution chilling zone range from 130° to −20° F, 100° to −20° F and 70° to −60° F, respectively.

13. The process of claim 12 wherein the dewaxed second raffinate yields a lube oil having a VI of at least about 70.

* * * * *